US012637631B2

(12) United States Patent
Björklund

(10) Patent No.: US 12,637,631 B2
(45) Date of Patent: May 26, 2026

(54) METHOD AND SYSTEM FOR PROCESSING LIGNOCELLULOSE BIOMASS MATERIAL

(71) Applicant: VALMET AB, Sundsvall (SE)

(72) Inventor: Peter Björklund, Umeå (SE)

(73) Assignee: VALMET AB, Sundsvall (SE)

( * ) Notice: Subject to any disclaimer, the term of this patent is extended or adjusted under 35 U.S.C. 154(b) by 0 days.

(21) Appl. No.: 18/862,681

(22) PCT Filed: Mar. 29, 2023

(86) PCT No.: PCT/SE2023/050284
§ 371 (c)(1),
(2) Date: Nov. 4, 2024

(87) PCT Pub. No.: WO2023/214907
PCT Pub. Date: Nov. 9, 2023

(65) Prior Publication Data

US 2025/0346823 A1 Nov. 13, 2025

(30) Foreign Application Priority Data

May 6, 2022 (SE) ..... 2230135-2

(51) Int. Cl.
*C10L 5/44* (2006.01)
*C10L 5/36* (2006.01)
*D21B 1/36* (2006.01)

(52) U.S. Cl.
CPC ..... *C10L 5/44* (2013.01); *C10L 5/361* (2013.01); *C10L 5/363* (2013.01); *D21B 1/36* (2013.01);
(Continued)

(58) Field of Classification Search
CPC .. C10L 5/44; C10L 5/361; C10L 5/363; C10L 2290/141; C10L 2290/28; C10L 2290/50; D21B 1/36
See application file for complete search history.

(56) References Cited

U.S. PATENT DOCUMENTS

2011/0302832 A1* 12/2011 Gronn ..... C10L 5/361 44/589
2013/0244290 A1 9/2013 Retsina et al.
(Continued)

FOREIGN PATENT DOCUMENTS

SE 541264 C2 5/2019
SE 01950001 A1 10/2019
(Continued)

OTHER PUBLICATIONS

Oriez et al., "Lignocellulosic Biomass Fractionation by Mineral Acids and Resulting Extract Purification Processes: Conditions, Yields, and Purities", Molecules, vol. 24, Nov. 23, 2019, pp. 1-21.
(Continued)

*Primary Examiner* — Cephia D Toomer
(74) *Attorney, Agent, or Firm* — Foley & Lardner LLP

(57) ABSTRACT

A method for processing a lignocellulose biomass material with a moisture content below 10 weight-% and an ash content below 1.0 weight-% includes: adding an acid catalyst to the lignocellulose biomass material; after adding the acid catalyst, thermally treating the lignocellulose biomass material with steam at an elevated pressure and an elevated temperature in at least one reactor; discharging the lignocellulose biomass material and blow steam from the at least one reactor using a steam explosion discharge device; and forming pellets and/or briquettes from at least part of the discharged thermally treated lignocellulose biomass material.

16 Claims, 5 Drawing Sheets

(52) U.S. Cl.
CPC ..... *C10L 2290/141* (2013.01); *C10L 2290/28* (2013.01); *C10L 2290/50* (2013.01)

(56) References Cited

U.S. PATENT DOCUMENTS

| | | | | |
|---|---|---|---|---|
| 2015/0004654 | A1* | 1/2015 | Retsina ..... | C13K 13/00 44/578 |
| 2022/0089962 | A1 | 3/2022 | Despres et al. | |

FOREIGN PATENT DOCUMENTS

| | | | |
|---|---|---|---|
| SE | 543000 | C2 | 9/2020 |
| SE | 2050638 | A1 | 12/2021 |
| WO | WO-2012/103220 | A1 | 8/2012 |
| WO | WO-2020/005130 | A1 | 1/2020 |
| WO | WO-2021/167511 | A1 | 8/2021 |

OTHER PUBLICATIONS

Ramos, Luiz Pereira, "The chemistry involved in the steam treatment of lignocellulosic materials", In: Quim. Nova, Dec. 2003, vol. 26, No. 6, pp. 863-871 [retrieved Oct. 27, 2022], Retrieved from: https://doi.org/10.1590/S0100-40422003000600015.

Tang et al., "Influence of steam explosion processes on the durability and enzymatic digestibility of wood pellets", Fuel, vol. 211, Jan. 2018, p. 87-94, [retrieved on Oct. 27, 2022], Retrieved from: https://doi.org/10.1016/j.fuel.2017.09.053.

Swedish Search Report issued Oct. 31, 2022 in Swedish Application No. 2230135-2.

* cited by examiner

METHOD AND SYSTEM FOR PROCESSING LIGNOCELLULOSE BIOMASS MATERIAL

TECHNICAL FIELD

The invention relates to the field of methods for processing lignocellulose biomass material comprising catalyzed thermal treatment (hydrolysis) of the biomass material followed by steam explosion discharge. The invention also relates to a corresponding system.

BACKGROUND

Thermal treatment of lignocellulose biomass material at elevated pressure and temperature is known in the art. Such thermal treatment is used for example to produce fiber board, fuel pellets/briquettes and ethanol and other chemicals. Pellets produced with thermal treatment are usually referred to as black pellets due to their dark color. One advantageous method for thermal treatment is steam explosion. Steam explosion refers to a process step where the material undergoes a rapid/instantaneous pressure decrease. Hot and softened biomass from thermal treatment is released or blown from a pressurized reactor through a blow valve or orifice, while the pressure drops to an environment with substantially lower pressure, such as below 5 bar, or preferably to substantially atmospheric pressure. The structure of the biomass breaks, partly due to the expanding steam, and partly by the shear forces and impact during the blow through the orifice or valve. Hydrolyzed and steam exploded wood is excellent raw material for densification to pellets or briquettes. Steam explosion treatment improves the strength of the resulting pellet due to various substances such as lignin and sugars being released during the steam explosion.

SE2050638 proposes drying the biomass material prior to thermal treatment to reduce the amount of steam needed to heat the biomass material. Wood material without bark typically has a sulphur content of less than 0.05%, which means that the process described in SE2050638 provides pellets with low sulphur content which is an advantage since the $SO_2$-emission from combustion will be low.

SE541264 proposes adding a mineral acid, for example sulphuric acid to the hydrothermal treatment reactor to catalyze the thermal treatment process to release more sugars from carbohydrates for further processing to for example ethanol and bio-based chemicals. Although adding a catalyst may be advantageous to produce ethanol and bio-based chemicals (where the thermal treatment constitutes a pre-hydrolysis stage followed for example by an enzymatic hydrolysis stage), the results may be less advantageous when producing pellets/briquettes from the thermally treated biomass material since the sulphur content in the product may be unacceptably high. Furthermore, depending on the biomass material used, acid consumption may be excessive to achieve a catalyzing effect.

SUMMARY

An object of the invention is to provide a method and a system which solves or at least improves on the disadvantages of the prior art described above.

These and other objects are achieved by the present invention by means of a method and a system according to the independent claims.

According to a first aspect of the invention, there is provided a method for processing a lignocellulose biomass material with a moisture content below 10 weight-%, or below 8 weight-%, or below 6 weight-%. The method comprises thermally treating the lignocellulose biomass material with steam at elevated pressure and temperature in at least one pressurized reactor followed by discharge of lignocellulose biomass material and blow steam from the at least one reactor. The discharging comprises subjecting the lignocellulose biomass material to steam explosion discharge. Thus, the lignocellulose biomass material is discharged by a steam explosion discharge device. The method further comprises forming pellets and/or briquettes from at least part of the discharged thermally treated lignocellulose biomass material. Prior to the thermally treating, an acid catalyst is added to the lignocellulose biomass material. Alternatively, the acid catalyst can be added to the lignocellulose material during the thermally treating, i.e. added to the thermal treatment reactor. The lignocellulose biomass material can have an ash content below 1.0 weight-%.

The lignocellulose biomass material is provided "dry" in the sense that it has a moisture content to below 10 or 8 or 6 weight-%, or it is subjected to thermal drying for reducing the moisture content to below 10 or 8 or 6 weight-%. Thermal drying can be preceded by mechanically dewatering the biomass to obtain a moisture content in the range 35-55%. An acid catalyst such as sulphuric acid is added as catalyst to the dry lignocellulose biomass material prior to being subjected to thermal treatment with steam at elevated temperature in at least one pressurized reactor. The lignocellulose biomass material is subjected to steam explosion discharge after thermal treatment and pellets and/or briquettes are formed from at least part of the discharged lignocellulose biomass material.

The sulphur content of the pellets/briquettes will increase when adding an acid catalyst (such as sulphuric acid) to the biomass material. But sulphuric acid is consumed by the neutralizing ash in the raw material, and a big part of the reacted sulphur stays in the solid phase also at combustion of the pellets. This is advantageous since sulphur exits the combustion process largely as fly-ash separated in flue gas cleaning system and not as sulphur dioxide.

The invention is based on the insight that it is possible to catalyze a dry thermal treatment process for production of pellets or briquettes, such that the final product still has a low content of reactive sulphur that could escape to atmosphere during combustion. Further the thermally treated biomass has low moisture content and drying of it before densification to pellets or briquettes is not required. Compared to a thermal treatment process without catalyst addition, the reaction rate will be higher which allows a higher output for a given reactor size or allows the reactor size to be smaller for a given output.

The invented method provides a simple acidulation process, without large soaking containers, acid presses, filters and acid recycle systems.

Common raw-materials for fuel pellet production, such as saw-dust, shavings, chips, or splinters from debarked wood have rather low ash content, typically on the range 0.3-0.8 weight-%. An ash content of below 1 weight-% allow to keep the acid catalyst charge at low levels yielding only a low to moderate increase of sulphur in the final product and this sulphur is largely chemically bound to the alkaline ash of the raw material.

In embodiments, the acid catalyst can be sulphuric acid. The sulphuric acid can be added at an acid admixture ratio k defined as kg concentrated sulphuric acid per kg ash in the lignocellulose biomass material, where $1.6<k<2.5$. This embodiment is based on the insight that most of the acid catalyst is consumed by the ash of the lignocellulose material which has a neutralizing effect, and thus that there is a correlation between the optimum amount of sulfuric acid catalyst to be added and the amount of ash in the lignocellulose material. The ash content of the raw material will be determined by analyzing in a laboratory and the catalyst charge is calculated from the relevant k-value.

In embodiments, the acid catalyst is added in the form of a liquid solution having a concentration of 35-65 weight-%. Adding the acid catalyst at such high concentration is advantageous since the increase in moisture (water) content is kept low. Use of concentrated sulphuric acid (>93-weight-%) is not possible however as such strong acid dehydrates moist dry wood and carbonizes organic raw material.

In embodiments, the acid catalyst can also be a sulphonic acid for example methyl-sulphonic acid or par-toluene sulphonic acid.

In embodiments, the acid catalyst is added by means of spraying the acid in the form of an aerosol spray onto the lignocellulose biomass material. This may be advantageous since the acid can be distributed over a large surface area of the dry biomass. The acid catalyst can for example be sprayed onto lignocellulose biomass material in a storage tower or bin.

In embodiments, the acid catalyst is added to the lignocellulose biomass material in at least one screw conveyor prior to the pressurized reactor. The acid catalyst can be sprayed into the screw conveyor by means of spray nozzles. The screw conveyor can be a paddle screw conveyor comprising a plurality of paddles extending substantially radially from a rotational shaft and at a distance from each other in an axial direction of the rotational shaft. Paddle screw conveyors per se are known in the art but provides particularly advantageous use in this application, where the mixing effect provided by the paddles improves mixing between the acid catalyst and the biomass and can also increase transport of the acid catalyst into the biomass.

In embodiments, the method further comprises, prior to said thermally treating and after said adding, compressing, and feeding the lignocellulose biomass material towards the at least one pressurized reactor by means of at least one plug screw device. Using a plug screw device for feeding the material can be advantageous since the acid catalyst can be further improve transport of the acid catalyst into the biomass. This embodiment can advantageously be combined with the embodiments above using screw conveyor(s), with the plug screw device(s) being arranged downstream of the screw conveyor(s).

According to a second aspect of the invention, there is provided a system for processing a lignocellulose biomass material. The system comprises a drying arrangement configured to reduce the moisture content of the lignocellulose biomass material to below 10 weight-%, or to below 8 weight-%, or to below 6 weight-%, a catalyst addition device configured to add an acid catalyst to lignocellulose biomass material from the drying arrangement, at least one pressurized reactor arranged to receive the lignocellulose biomass material with said acid catalyst added, said at least one reactor being provided with means for adding steam into said at least one reactor for thermal treatment of the biomass material at elevated pressure and temperature, at least one steam explosion discharge device arranged to discharge the biomass material and blow steam vapor from the at least one reactor, and at least one pelleting device arranged to receive lignocellulose biomass material from the at least one steam explosion discharge device to produce fuel pellets and/or briquettes. Drying arrangements, pressurized reactors, means for adding steam, steam explosion discharge devices, and pelleting/briquetting devices are all known in the art and will not be explained in further detail here.

In embodiments, the system further comprises a control system configured to control said catalyst addition device such that acid is added at an acid admixture ratio k defined as kg concentrated sulphuric acid per kg ash in the lignocellulose biomass material, where $1.6<k<2.5$.

In embodiments of the method and the system, the steam explosion discharge device can comprise a blow valve/orifice, over which the pressure drops to a substantially lower pressure, preferably to substantially atmospheric pressure. The steam explosion discharge device can furthermore comprise, or be preceded by, a pressure sealing screw arranged at a bottom portion of the reactor and a discharge chamber connected to the pressure sealing screw to receive discharged biomass, wherein the blow valve/orifice is arranged for arranged for steam explosion discharge of the biomass from said discharge chamber. Discharge steam can be added to the discharge chamber to control the pressure therein. Such a steam explosion discharge arrangement comprising a pressure sealing screw is described in SE543000C2, which is hereby incorporated by reference.

According to a third aspect of the invention, there is provided an acid catalyst addition device configured to add catalyst to lignocellulose biomass material having a moisture content below 10 or 8 or 6 weight-% and an ash content below 1.0 weight-%. The catalyst addition device comprises at least one spray nozzle and a paddle screw conveyor. The paddle screw conveyor comprises a substantially cylindrical housing and a paddle screw rotatably arranged therein.

The paddle screw comprises a plurality of paddles extending substantially radially from a rotational shaft and at a distance from each other in an axial direction of the rotational shaft, the paddles being angled relative the axial direction such as to convey the biomass material substantially in the axial direction. The at least one spray nozzle is arranged through the wall of the substantially cylindrical housing to spray acid catalyst (in the form of an aerosol spray) onto lignocellulose biomass material in the paddle screw conveyor. The paddles may be described as substantially plane and may be shaped substantially as a circle sector.

The features of the embodiments described above are combinable in any practically realizable way to form embodiments having combinations of these features. Further, all features and advantages of embodiments described above with reference to the first aspect of the invention can be applied in corresponding embodiments of the second and third aspects of the invention and vice versa.

BRIEF DESCRIPTION OF THE DRAWINGS

Above discussed and other aspects of the present invention will now be described in more detail using the appended drawings, which show presently preferred embodiments of the invention, wherein:

FIG. 6 shows the effect on pH, FIG. 7 shows the increase in gross heating value and FIG. 8 shows furfural yield.

DETAILED DESCRIPTION

Figure 1:
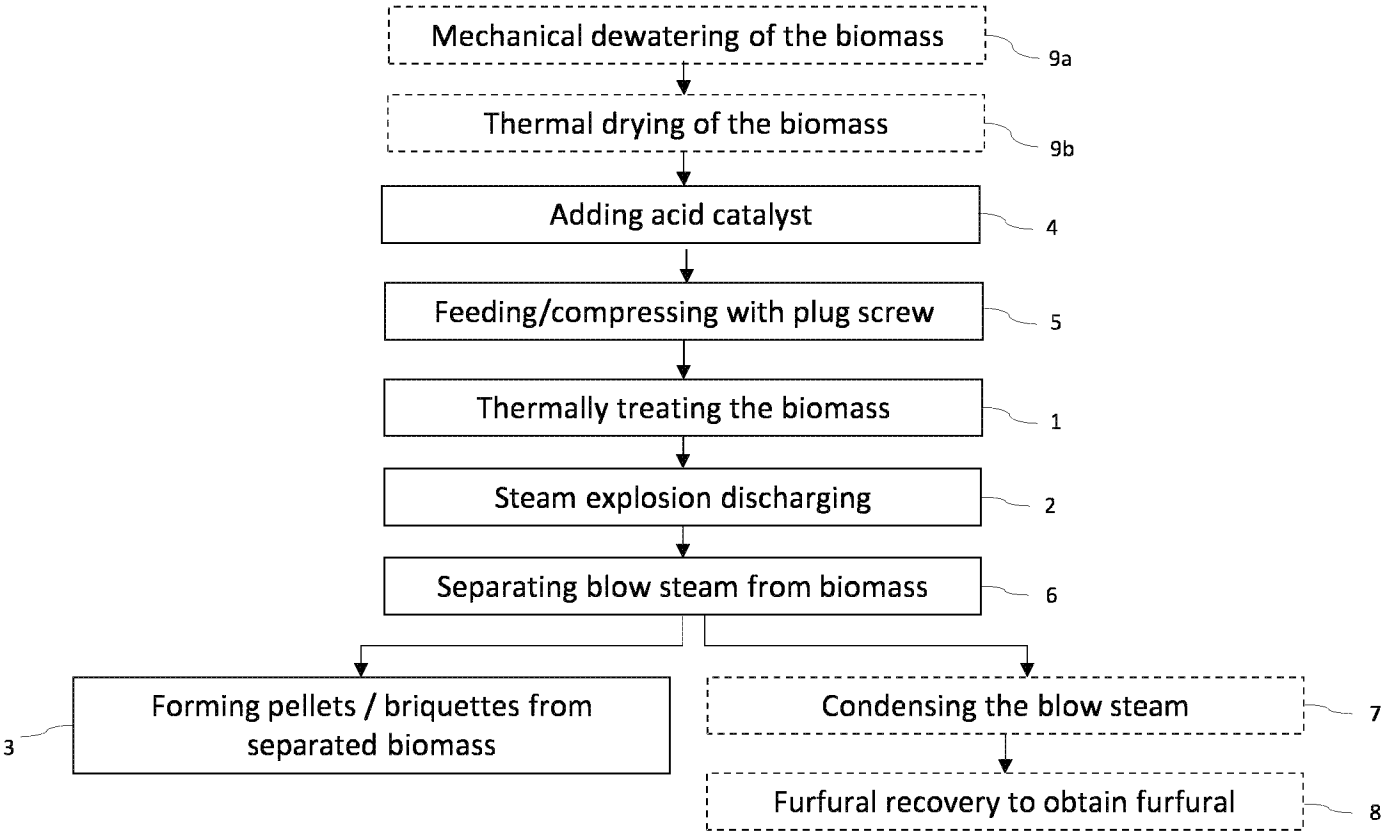
FIG. 1 shows a flow chart illustrating an embodiment of the method according to the first aspect of the invention.
Figure 2:
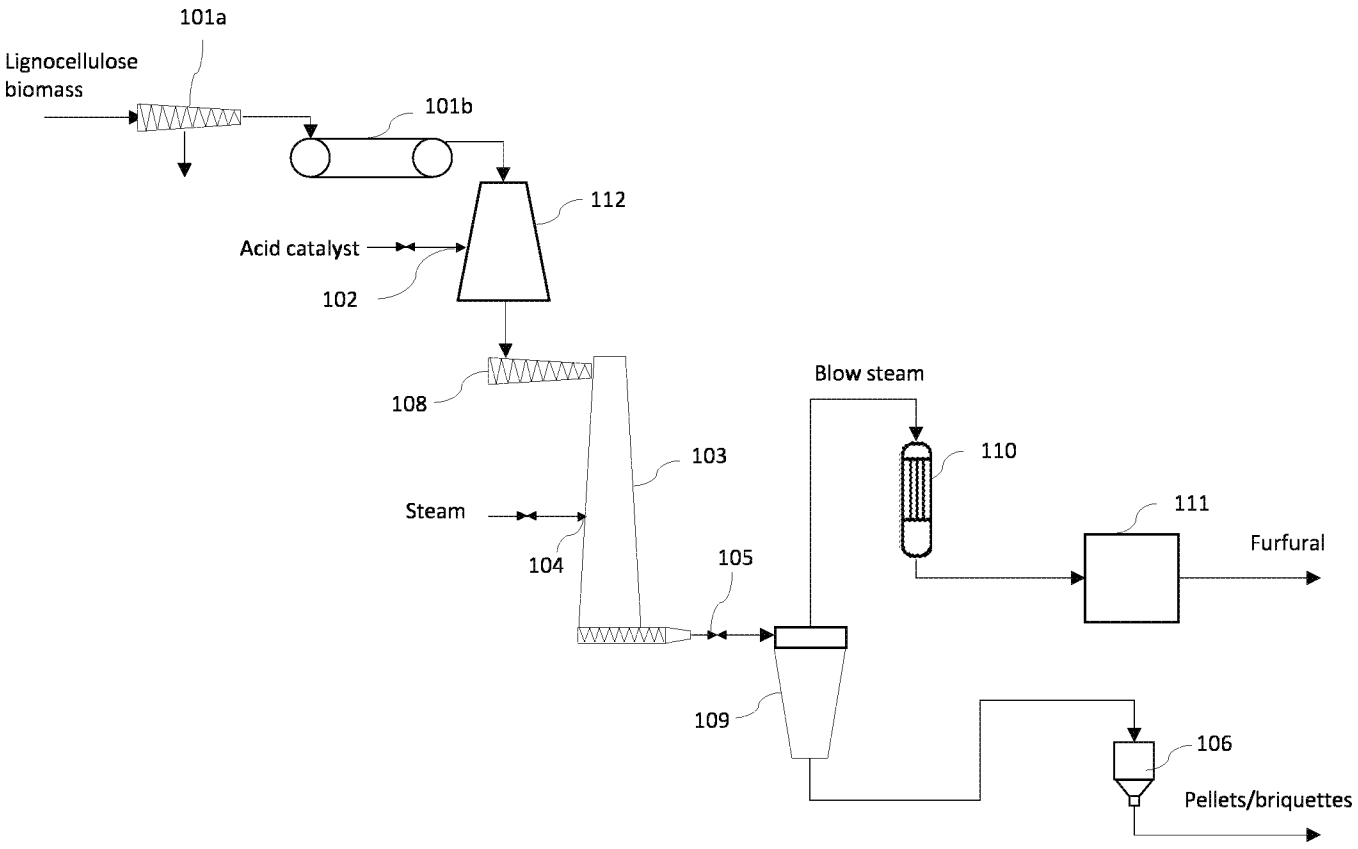
FIG. 2 shows a schematic illustration of an embodiment of the system according to the second aspect of the invention.
Figure 3:
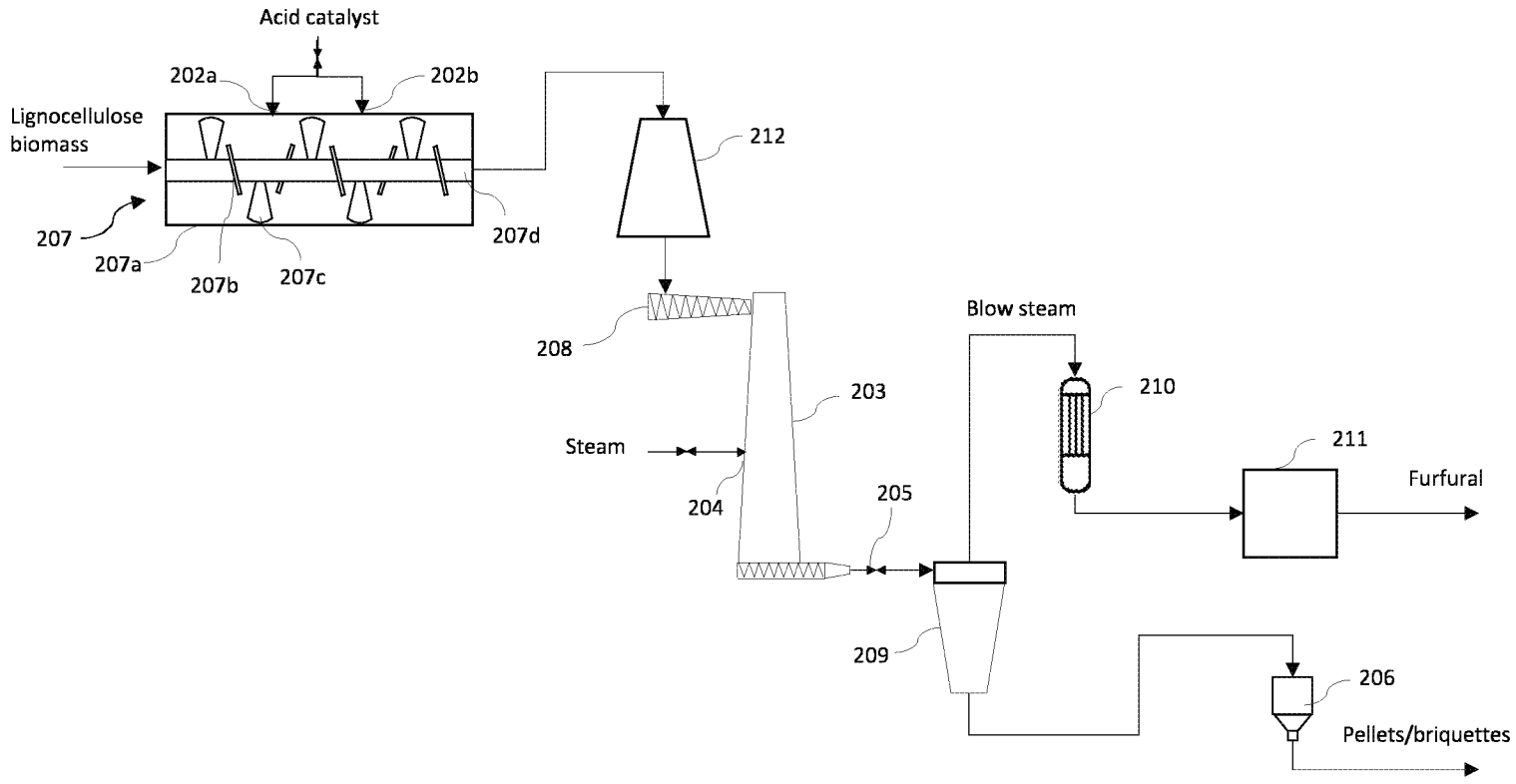
FIG. 3 shows a schematic illustration of another embodiment of the system according to the second aspect of the invention, which system comprises an embodiment of a catalyst addition device according to the third aspect of the invention.

FIG. 1 shows a flow chart illustrating an embodiment of the method according to the first aspect of the invention. The method comprises thermally treating 1 lignocellulose biomass material (for instance wood material in the form chips, splinters, shavings, sawdust or alike) having at elevated pressure and temperature, for instance in a pressurized reactor vessel as will be explained below with reference to FIGS. 2-3. The lignocellulose biomass material fed subjected to thermally treating has an ash content below 1.0 weight-% and a moisture content below 10 weight-%, or in other embodiments below 8 or 6 weight-%. If the biomass has a moisture content being equal to or above 10 weight-% (or equal to or above 8 weight-% or 6 weight-%), the method comprises reducing the moisture content of the biomass prior to thermally treating by means of mechanically dewatering the biomass 9*a* (for example using a screw press) and/or thermal drying 9*b* of the biomass (for example using a low-temperature belt dryer). Following step 9*a* and/or 9*b*, the biomass has a moisture content of below 10 weight-% (or below 8 weight-%, or below 6 weight-%). If the biomass has a moisture content below 10 weight-% (or below 8 weight-%, or below 6 weight-%), steps 9*a*, 9*b* are omitted. Prior to thermally treating 1, a catalyst being sulphuric acid is added to the dry biomass at an acid admixture ratio k defined as kg concentrated sulphuric acid per kg ash in the lignocellulose biomass material, where $1.6<k<2.5$. The acid catalyst is added by means of spraying it onto the biomass material, for example into a storage tower/bin or into a paddle screw conveyor as illustrated in FIGS. 2-3 and explained below. The thermally treated biomass along with blow steam is discharged 2 by means of a steam explosion discharge device. The blow steam is thereafter separated 6 from the discharged thermally treated lignocellulose biomass material, for example using a cyclone. The blow steam is optionally condensed 7 to form a blow steam condensate, which condensate is thereafter optionally subjected to a furfural recovery process 8 to obtain furfural. Furfural recovery processes are known in the art, and may be of the type described in WO2021167511, which is hereby incorporated by reference. Pellets and/or briquettes are formed 3 from at least part of the discharged thermally treated lignocellulose biomass material.

FIG. 2 illustrates schematically an embodiment of the system according to the second aspect of the invention. In this embodiment, the system is provided with moist lignocellulose biomass having a moisture content of for example above 35 weight-% and having an ash content of less than 1.0 weight-%. The system comprises a mechanical dewatering apparatus being for example a screw-press 101*a*, which is configured to dewater the lignocellulose biomass material to obtain a moisture content in the range 35-55 weight-%. Following the screw-press, a low temperature belt dryer 101*b* is arranged, which is configured to thermally dry the biomass material to a moisture content below 10 weight-% (or below 8 or 6 weight-%). The dewatered and dried lignocellulose biomass material is fed to a storage tower/bin 112 which is provided with a catalyst addition device 102 comprising at least one spray nozzle (schematically illustrated in the figure as an arrow) arranged to spray acid catalyst in the form of an aerosol spray onto the lignocellulose biomass material in the tower/bin 112. The lignocellulose biomass material with acid catalyst added is fed from the tower/bin 112 to a pressurized thermal treatment reactor 103 using a plug-screw 108. The plug-screw compresses the biomass to a plug such that the high pressure in the thermal reactor 103 is sealed from the atmospheric pressure. The thermal reactor 103 is provided with means 104 for adding steam into said reactor for thermal treatment of the lignocellulose biomass material at elevated pressure and temperature, and at least one steam explosion discharge device 105 arranged to discharge the thermally treated biomass and blow steam (comprising steam and vapors released from the biomass material during thermal treatment). The steam explosion discharge device 105 comprises a blow valve/orifice, over which the pressure drops to a substantially lower pressure, preferably to substantially atmospheric pressure. In other embodiments, the steam explosion discharge device can furthermore comprise a pressure sealing screw arranged to discharge the thermally treated biomass and blow steam to a discharge chamber, where the blow valve/orifice is arranged to discharge the thermally treated biomass and blow steam from the discharge chamber. Furthermore, steam can be added to the discharge chamber for pressure control. Collecting means in the form of a separator (a cyclone) 109 is connected to the steam explosion discharge device 105 to separate blow steam from the lignocellulose biomass material. A condensing device 110 is connected to the separator 109 to condense the blow steam. A furfural recovery system 111 is connected to the condensing device 110 to receive the blow steam condensate to provide furfural separated from the blow steam condensate. Furfural recovery systems are known in the art and may be of the type described in WO2021167511. The thermally treated lignocellulose biomass material is fed from separator 109 to a pelleting/briquetting device 106 to produce fuel pellets/briquettes.

FIG. 3 shows a schematic illustration of another embodiment of the system according to the second aspect of the invention. This embodiment corresponds to the embodiment in FIG. 2 in that it comprises devices 203-206, 208-212 corresponding to devices 103-106, 108-112, respectively. The embodiment however differs in that the lignocellulose biomass material is provided dry having a moisture content of less than 10 weight-%, or in other embodiments below 8 weight-% or 6 weight-%. Consequently, the screw-press and belt dryer in FIG. 2 are omitted. Instead, a paddle screw conveyor 207 precedes the storage bin/tower 212. Further, the acid catalyst is added into the paddle screw conveyor rather than into the storage tower/bin as in FIG. 2.

The paddle screw conveyor 207, which is shown greatly exaggerated in size for illustrative purposes, comprises a substantially cylindrical housing 207*a* and a paddle screw 207*b* rotatably arranged therein. The paddle screw comprises a plurality of paddles (207*b*, 207*c* for example) extending substantially radially from a rotational shaft 207*d* and at a distance from each other in an axial direction of the rotational shaft, the paddles being angled relative the axial direction such as to convey the biomass material substantially in the axial direction. As can be seen in FIG. 3, the paddles are also distributed angularly around the rotational shaft. Further, as can be seen in FIG. 3, the paddles may be described as substantially plane and shaped substantially as circle sectors. This embodiment is illustrated with two spray nozzles 202*a*, 202*b* arranged at an axial distance from each other through the wall of the substantially cylindrical housing to spray sulfuric acid catalyst in the form of an aerosol spray onto lignocellulose biomass material in the paddle screw conveyor. In other embodiments, additional spray nozzles may be provided.

In other embodiments, a conventional screw conveyor having a continuously formed screw replaces the paddle screw conveyor.

The paddle screw conveyor 212 along with the spray nozzles 202*a-b* also schematically illustrate an embodiment of a catalyst addition device according to the third aspect of the invention.

The amount of acid added by means of the spray nozzles 102, 202*a-b* in FIGS. 2-3 is advantageously controlled by a (not shown) control system such that sulfuric acid is added to the dry biomass at an acid admixture ratio k as kg concentrated sulfuric acid per kg ash in the lignocellulose biomass material which is $1.6<k<2.5$.

Typical operating conditions of thermal treatment embodiments described above with reference to FIGS. 1-3 are as follows:

Temperature in reactor: 140-225° C.

Pressure: corresponding pressure 2-30 bar(g)

Residence time: 1 minute-60 minutes, preferably 3-20 minutes.

Although not explicitly shown or described above, it is understood that the systems in FIGS. 2-3 comprise feeding devices such as feeding screws, pumps, or valves where appropriate to convey and control the flows of biomass material, steam etc. between the shown devices.

It is further noted that the devices forming part of the described embodiments of the system, and used in the embodiments of the method, (such as screw-presses, belt dryers, screw conveyors, storage towers/bins, spray nozzles, pressurized reactors, condensing devices, pelleting devices, cyclones, steam explosion discharge devices etc.) are all well known in the art and will therefore not be described in further detail herein.

Figure 4:
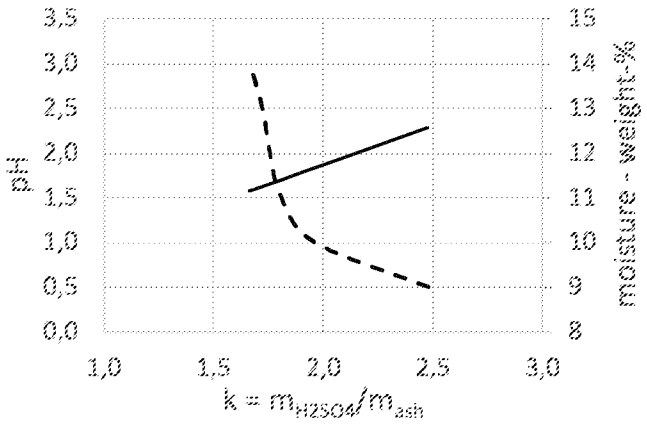
FIG. 4 shows examples of the pH value and moisture content achieved as function of sulphuric acid charged.
Figure 5:
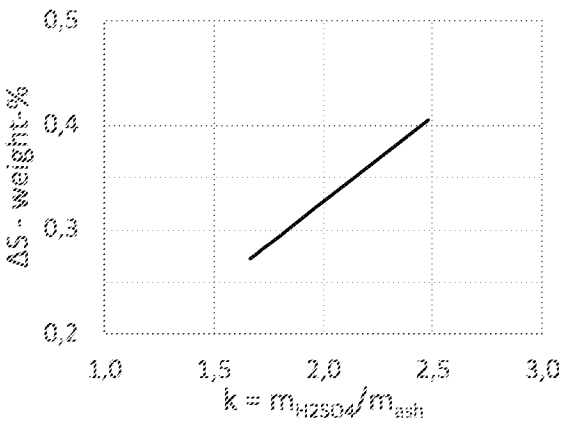
FIG. 5 shows the increase in sulphur content as function of sulfuric acid charged.

FIG. 4 shows (left ordinate) the pH value achieved as function of sulfuric acid charged. Sulfuric acid charge is k=mass 100% sulfuric acid per mass of dry ash, where k can also be referred to as the acid admixture ratio. As can be seen in the figure, k is within a range from 1.6 to 2.5. The right ordinate is the moisture content of the final product, from step 3. The moisture increases with catalyst charge since the catalyst added is diluted with water. The final moisture also depends on the moisture after drying step (a). The right ordinate of FIG. 4 is calculated with 8 weight-% moisture after step 9*a-b* and 45% catalyst concentration. The catalyst will bring sulphur to the final product, the increase in sulphur content can be read from FIG. 5.

Figure 7:
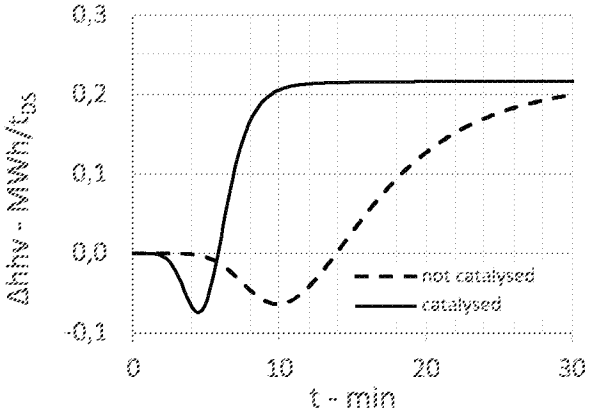
FIGS. 6-8 show an example of the catalyzing effect, where
Figure 6:
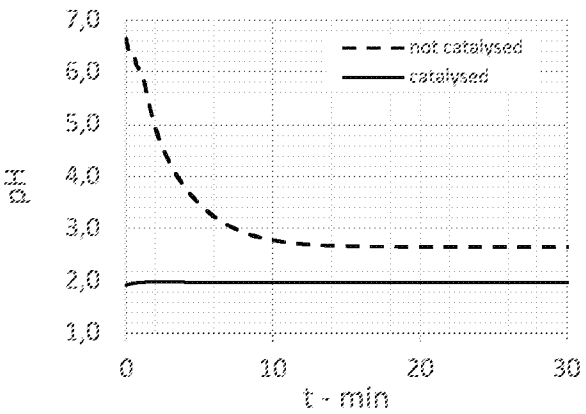
Figure 8:
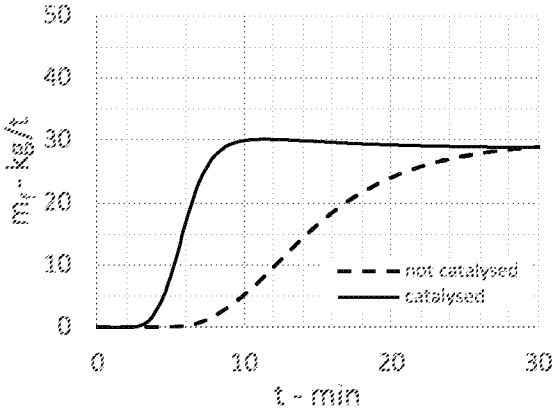

The pH value of an un-catalyzed process is pH=7 when hydrolysis starts and drops about to pH=2.5 during the hydrolysis because hemicelluloses release acetyl (acetic acid) which acidulate the material (see example in FIG. 6). Low pH is advantageous as the released protons catalyze both hydrolysis and dehydration reactions. Adding a strong acid to the process will significantly speed up the reactions as the pH value decrease below what is achievable with the naturally occurring acetic acid in an un-catalyzed process. Acidulation is especially valuable at start of the hydrolysis as the process can start at low pH in comparison with the neutral value of an un-catalyzed process (see example in FIG. 6). The reaction rates are roughly direct proportional to the proton concentration, decreasing pH one step means 10-fold increase in reaction rate. The effect of catalyzing the process is much less in practice due to macro phenomena i.e., diffusional processes of liquids and vapors in the wood pores; concentration gradients in the pile of wood in the reactor; vapor liquid equilibrium (approach) etc. But the catalyzing effect is still significant in practice resulting in over 50% reduction in reaction time (reactor volume of step 1) in comparison to an un-catalyzed process. FIGS. 7 and 8 show the effect of the catalyst on heating value change and furfural production. From FIG. 7; if a gross heating value increase 0.1 MWh/tDS is targeted (gross heat value increase=gross heat value of product minus gross heat value of raw material) it can be achieved at 7 minutes with a catalyzed process in comparison to 18 minutes with an un-catalyzed process. The same effect can be seen in furfural yield diagram FIG. 8.

The description above and the appended drawings are to be considered as non-limiting examples of the invention. The person skilled in the art realizes that several changes and modifications can be made within the scope of the invention. For example, the thermal treatment system can comprise a different type of reactor such as a horizontal reactor, the acid catalyst can be added at another position upstream of the pressurized reactor, the storage tower/bin may be omitted. The scope of protection is determined by the appended patent claims.

The invention claimed is:

1. A method for processing a lignocellulose biomass material, said method comprising:

adding an acid catalyst to the lignocellulose biomass material while the lignocellulose biomass material has a moisture content below 10 weight-% and an ash content below 1.0 weight-%;

after adding the acid catalyst, thermally treating the lignocellulose biomass material with steam at a pressure above atmospheric pressure and a temperature above atmospheric temperature in at least one reactor;

discharging the lignocellulose biomass material and blow steam from the at least one reactor using a steam explosion discharge device; and forming pellets and/or briquettes from at least part of the discharged thermally treated lignocellulose biomass material.

2. The method according to claim 1, wherein said acid catalyst is sulphuric acid.

3. The method according to claim 1, wherein an acid admixture ratio k as kg concentrated sulfuric acid per kg ash in the lignocellulose biomass material is $1.6<k<2.5$.

4. The method according to claim 1, wherein the acid catalyst is added in the form of a liquid solution having a concentration of 35-65 weight-%.

5. The method according to claim 1, wherein the acid catalyst is added to the lignocellulose biomass material in at least one screw conveyor prior to the reactor.

6. The method according to claim 5, wherein the screw conveyor is a paddle screw conveyor comprising a plurality of paddles extending substantially radially from a rotational shaft and at a distance from each other in an axial direction of the rotational shaft.

7. The method according to claim 1, wherein the acid catalyst is added by means of spraying the acid onto the lignocellulose biomass material.

8. The method according to claim 1, further comprising, prior to said thermally treating and after said adding, compressing and feeding the lignocellulose biomass material towards the at least one reactor using at least one plug screw device.

9. The method according to claim 1, further comprising:

separating the blow steam from the discharged thermally treated lignocellulose biomass material;

condensing the blow steam to obtain a blow steam condensate; and recovering furfural from said blow steam condensate.

10. The method according to claim 1, wherein said acid catalyst is a sulphonic acid.

11. A system for processing a lignocellulose biomass material, said system comprising:

a drying arrangement configured to reduce a moisture content of the lignocellulose biomass material to below 10 weight-%;

a catalyst addition device configured to add an acid catalyst to the lignocellulose biomass material from the drying arrangement while the lignocellulose biomass material has a moisture content below 10 weight-%;

at least one reactor configured to receive the lignocellulose biomass material with said acid catalyst added, said at least one reactor being provided with means for adding steam into said at least one reactor for thermal treatment of the biomass material at a pressure above atmospheric pressure and a temperature above atmospheric temperature;

at least one steam explosion discharge device configured to discharge the biomass material and blow steam vapor from the at least one reactor; and at least one pelleting device configured to receive the lignocellulose biomass material from the at least one steam explosion discharge device and to produce fuel pellets.

12. The system according to claim 11, further comprising:

at least one conveying screw device configured to convey the lignocellulose biomass to the at least one reactor;

wherein said catalyst addition device comprises at least one spray nozzle configured to spray said acid catalyst into the at least one conveying screw device.

13. The system according to claim 12, wherein the screw conveyor is a paddle screw conveyor comprising a plurality of paddles extending substantially radially from a rotational shaft and at a distance from each other in an axial direction of the rotational shaft.

14. The system according to claim 11, further comprising at least one plug screw device configured to compress and feed the lignocellulose material with said catalyst added to the at least one reactor.

15. The system according to claim 11, further comprising a control system configured to control said catalyst addition device such that acid is added at an acid admixture ratio k defined as kg concentrated sulfuric acid per kg ash in the lignocellulose biomass material, where $1.6<k<2.5$.

16. The system according to claim 11, further comprising:

separating means connected to the at least one steam explosion discharge device to separate said blow steam from the discharged thermally treated biomass material;

at least one condensing device configured to receive said blow steam from said separating means and to provide a blow steam condensate; and a furfural recovery system configured to receive said blow steam condensate from said at least one condensing device and to provide furfural separated from said blow steam condensate.

* * * * *